US008922456B2

(12) United States Patent
Tabata et al.

(10) Patent No.: US 8,922,456 B2
(45) Date of Patent: Dec. 30, 2014

(54) DEPLOYABLE ANTENNA

(75) Inventors: Minoru Tabata, Tokyo (JP); Kiyoshi Fujii, Tokyo (JP); Kyoji Shintate, Ibaraki (JP); Satoru Ozawa, Ibaraki (JP)

(73) Assignees: NEC TOSHIBA Space Systems, Ltd., Tokyo (JP); Japan Aerospace Exploration Agency, Tokyo (JP)

( * ) Notice: Subject to any disclaimer, the term of this patent is extended or adjusted under 35 U.S.C. 154(b) by 206 days.

(21) Appl. No.: 13/361,234

(22) Filed: Jan. 30, 2012

(65) Prior Publication Data

US 2012/0193498 A1 Aug. 2, 2012

(30) Foreign Application Priority Data

Jan. 31, 2011 (JP) ..... 2011-017529

(51) Int. Cl.

| | |
|---|---|
| ***H01Q 15/20*** | (2006.01) |
| ***H01Q 1/12*** | (2006.01) |
| ***H01Q 15/16*** | (2006.01) |
| ***H01Q 1/28*** | (2006.01) |

(52) U.S. Cl.

CPC ..... *H01Q 15/161* (2013.01); *H01Q 1/288* (2013.01)

USPC ..... 343/915; 343/878; 343/880

(58) Field of Classification Search

CPC ..... H01Q 15/161; H01Q 1/288

See application file for complete search history.

(56) References Cited

U.S. PATENT DOCUMENTS

| | | | | |
|---|---|---|---|---|
| 5,014,484 | A * | 5/1991 | Tanizawa et al. | 52/646 |
| 6,215,458 | B1 * | 4/2001 | Aguttes et al. | 343/915 |
| 6,826,225 | B1 * | 11/2004 | Dupuis et al. | 375/222 |
| 6,836,215 | B1 * | 12/2004 | Laurash et al. | 340/572.1 |
| 7,216,995 | B2 * | 5/2007 | Harada et al. | 359/871 |
| 7,839,353 | B2 * | 11/2010 | Bassily | 343/915 |
| 2001/0038357 | A1 * | 11/2001 | Shipley et al. | 343/915 |
| 2002/0063660 | A1 * | 5/2002 | Harless | 343/915 |

(Continued)

FOREIGN PATENT DOCUMENTS

| | | |
|---|---|---|
| DE | 29 41 170 A1 | 6/1981 |
| EP | 0 290 729 A2 | 11/1988 |

(Continued)

OTHER PUBLICATIONS

Communication dated May 16, 2012 issued by the European Patent Office in Corresponding European Application No. 12152827.7.

(Continued)

*Primary Examiner* — Trin Dinh

(74) *Attorney, Agent, or Firm* — Sughrue Mion, PLLC

(57) ABSTRACT

A deployable antenna which has a larger aperture diameter by four-side links provided in at least three stages and which includes: six deployment link mechanisms (20) arranged radially from a central shaft so as to support an outer edge portion of a flexible reflector mirror surface; and one deployment driving mechanism (30) arranged at a lower portion of a center of arrangement of the six deployment link mechanisms, for unfolding the six deployment link mechanisms. Each of the six deployment link mechanisms includes a first four-side link (5), a second four-side link (6), and a third four-side link (7) arranged in an order from a position of the central shaft, around which the six deployment link mechanisms are arranged, toward an outer side of the each of the six deployment link mechanisms so that the each of the six deployment link mechanisms is structured to be foldable in three stages.

9 Claims, 13 Drawing Sheets

(56) References Cited

U.S. PATENT DOCUMENTS

| | | | | |
|---|---|---|---|---|
| 2003/0201949 | A1* | 10/2003 | Harless | 343/915 |
| 2006/0181788 | A1 | 8/2006 | Harada et al. | |
| 2007/0200789 | A1* | 8/2007 | Bassily | 343/915 |
| 2013/0107881 | A1* | 5/2013 | Barabash et al. | 370/389 |

FOREIGN PATENT DOCUMENTS

| | | | |
|---|---|---|---|
| JP | 11-112228 | A | 4/1999 |
| JP | 11247290 | A | 9/1999 |
| JP | 2000-183640 | A | 6/2000 |
| JP | 2001233299 | A | 8/2001 |
| JP | 2003-95199 | A | 4/2003 |
| JP | 2004146898 | A | 5/2004 |
| JP | 2006-80577 | A | 3/2006 |
| WO | 2005/027186 | A2 | 3/2004 |

OTHER PUBLICATIONS

Communication dated Jul. 2, 2014, issued by the Japanese Patent Office, in counterpart Application No. 2011017529.

* cited by examiner

DEPLOYABLE ANTENNA

This application is based upon and claims the benefit of priority from Japanese patent application No. 2011-017529, filed on Jan. 31, 2011, the disclosure of which is incorporated herein in its entirety by reference.

BACKGROUND OF THE INVENTION

1. Field of the Invention

This invention relates to a deployable antenna.

2. Description of the Related Art

The deployable antenna is transported in a folded state because of its limited stowage capacity during the transportation from ground to orbit. After transported to the orbit, the deployable antenna in the folded state is deployed as an antenna in the orbit.

FIGS. 1, 2, and 3 are illustrations of a deployable antenna A0 according to the related art. FIG. 1 is a view of the deployable antenna A0 as obliquely viewed to its front surface. FIG. 2 is a view of the deployable antenna A0 as obliquely viewed to its back surface. FIG. 3 is a view illustrating the back surface of the deployable antenna A0.

The deployable antenna A0 is a large deployable antenna having an aperture diameter size exceeding 10 m. In the deployable antenna A0 illustrated in the figures, a plurality of deployable antenna modules A1 (FIG. 1) are jointed to and driven in association with one another by joint members 40 (FIG. 3), to thereby attain the deployable antenna having a large aperture diameter. In the deployable antenna A0 illustrated in the figures, deployment driving mechanisms 30 (FIGS. 2 and 3) are provided to the respective deployable antenna modules A1, resulting in an increase in number of the deployment driving mechanisms 30 to be used, which are hard to reduce in weight. Consequently, there is a disadvantage that the mass of the deployable antenna A0 increases.

As described above, the module diameter size of each deployable antenna module A1 is smaller than the aperture diameter size of the deployable antenna A0. Therefore, in order to obtain the deployable antenna A0 having a large aperture diameter, a plurality of deployable antenna modules A1 need to be jointed to one another to increase the area of the antenna. However, in the method of jointing a plurality of deployable antenna modules A1 to one another to attain the deployable antenna A0, the number of the deployment driving mechanisms 30 to be used for the deployable antenna A0 increases, which leads to the disadvantage that the mass of the entire antenna increases.

Japanese Unexamined Patent Application Publication (JP-A) No. 2006-80577 discloses, in FIG. 3 and paragraphs [0024] and [0025], that each frame 2 is constructed of five planar links 3, and that the adjacent planar links 3 are jointed to each other in a mirror-image relationship.

Further, Japanese Unexamined Patent Application Publication (JP-A) No. 2006-80577 discloses, in FIG. 4 and paragraphs [0026], [0028] to [0031], and [0033], that the slide hinge 7 of each planar link 3 is moved by the wire driving device (extending means) 11 (corresponding to the deployment driving mechanism described above) to fold and unfold the frame 2.

However, as illustrated in FIG. 4 of Japanese Unexamined Patent Application Publication (JP-A) No. 2006-80577, the link member 4c of each planar link 3 is provided with the slide hinge 7, but the link member 4a opposed to the link member 4c is not provided with any slider for synchronized unfolding between the two adjacent planar links.

International Patent WO2005/027186A discloses, in FIG. 2 and lines 21 to 24 of page 7, that each frame 2 is constructed of five planar links 3, and that the adjacent planar links 3 are jointed to each other in a mirror-image relationship.

Further, International Patent WO2005/027186A discloses, in FIG. 3, lines 31 to 42 of page 7, and lines 48 to 50 of page 7, that the slide hinge 7 of each planar link 3 is moved by the wire driving device (extending means) 11 (corresponding to the deployment driving mechanism described above) to fold and unfold the frame 2.

However, as illustrated in FIG. 3 of International Patent WO2005/027186A, the link member 4c of each planar link 3 is provided with the slide hinge 7, but the link member 4a opposed to the link member 4c is not provided with any slider for synchronized unfolding between the two adjacent planar links.

Japanese Unexamined Patent Application Publication (JP-A) No. Hei 11-112228 discloses, in FIGS. 1 and 2 and paragraph [0025], the planar truss 1 in a state of being unfolded into a rectangular shape.

However, as illustrated in FIG. 2 of Japanese Unexamined Patent Application Publication (JP-A) No. Hei 11-112228, the central member 21 of the planar truss 1 is provided with the slider 27, but the peripheral member 22 opposed to the central member 21 is not provided with any slider similarly to Japanese Unexamined Patent Application Publication (JP-A) No. 2006-80577 and International Patent WO2005/027186A.

Japanese Unexamined Patent Application Publication (JP-A) No. 2003-95199 discloses, in FIGS. 1(a) and 1(b), FIG. 2, and paragraph [0019], the deployable antenna in which the bone members 14 each having two four-node links 12 and 13 continuously connected together are disposed around the central vertical beam member 11. As illustrated in FIG. 4 of Japanese Unexamined Patent Application Publication (JP-A) No. 2003-95199, in the disclosed deployable antenna, the synchronization mechanism 19 serving as unfolding synchronization means is provided to the central vertical beam member 11 so as to be movable in the axial direction thereof. One end of the synchronization cable 20 is fixed to the synchronization mechanism 19, and the other end of the synchronization cable 20 is fixed in the vicinity of the hinge of the inclined member 123 of the four-node link 12 of the bone member 14 under a state in which the synchronization cable 20 is looped around the guide pulley 201.

However, both the vertical beam member 122 opposed to the central vertical beam member 11 and the vertical beam member 132 opposed to the vertical beam member 122 are not provided with any slider similarly to Japanese Unexamined Patent Application Publication (JP-A) No. 2006-80577 and International Patent WO2005/027186A.

SUMMARY OF THE INVENTION

It is an object of this invention to provide a deployable antenna having a larger aperture diameter by four-side links provided in a plurality of stages.

According to this invention, it is possible to obtain a deployable antenna, including:

six deployment link mechanisms arranged radially from a central shaft of the deployable antenna so as to support an outer edge portion of a flexible reflector mirror surface of the deployable antenna; and one deployment driving mechanism arranged at a lower portion of a center of arrangement of the six deployment link mechanisms, for unfolding the six deployment link mechanisms, in which each of the six deployment link mechanisms includes a first four-side link, a second four-side link, and a third four-side link arranged in an order from a position of the central shaft, around which the six deployment link mechanisms are arranged, toward an outer side of the each of the six deployment link mechanisms so that the each of the six deployment link mechanisms is structured to be foldable in three stages, in which a central vertical link member of the first four-side link, which serves as the central shaft, includes a first slider, in which a common vertical link member between the first four-side link and the second four-side link includes a second slider, in which another common vertical link member between the second four-side link and the third four-side link includes a third slider, in which the one deployment driving mechanism causes the first slider to slide upwardly along the central vertical link member, to thereby unfold the first four-side link, in which the unfolded first four-side link causes the second slider to slide upwardly along the common vertical link member, to thereby unfold the second four-side link, and in which the unfolded second four-side link causes the third slider to slide upwardly along the another common vertical link member, to thereby unfold the third four-side link.

Further, according to this invention, it is possible to obtain a deployable antenna, including:

eight deployment link mechanisms arranged radially from a central shaft of the deployable antenna so as to support an outer edge portion of a flexible reflector mirror surface of the deployable antenna; and one deployment driving mechanism arranged at a lower portion of a center of arrangement of the eight deployment link mechanisms, for unfolding the eight deployment link mechanisms, in which each of the eight deployment link mechanisms includes a first four-side link, a second four-side link, and a third four-side link arranged in an order from a position of the central shaft, around which the eight deployment link mechanisms are arranged, toward an outer side of the each of the eight deployment link mechanisms so that the each of the eight deployment link mechanisms is structured to be foldable in three stages, in which a central vertical link member of the first four-side link, which serves as the central shaft, includes a first slider, in which a common vertical link member between the first four-side link and the second four-side link includes a second slider, in which another common vertical link member between the second four-side link and the third four-side link includes a third slider, in which the one deployment driving mechanism causes the first slider to slide upwardly along the central vertical link member, to thereby unfold the first four-side link, in which the unfolded first four-side link causes the second slider to slide upwardly along the common vertical link member, to thereby unfold the second four-side link, and in which the unfolded second four-side link causes the third slider to slide upwardly along the another common vertical link member, to thereby unfold the third four-side link.

According to this invention, it is possible to obtain the deployable antenna having a larger aperture diameter by the four-side links provided in the plurality of stages.

DETAILED DESCRIPTION OF THE PREFERRED EMBODIMENTS

Now, embodiments of this invention are described in detail.

Figure 3:
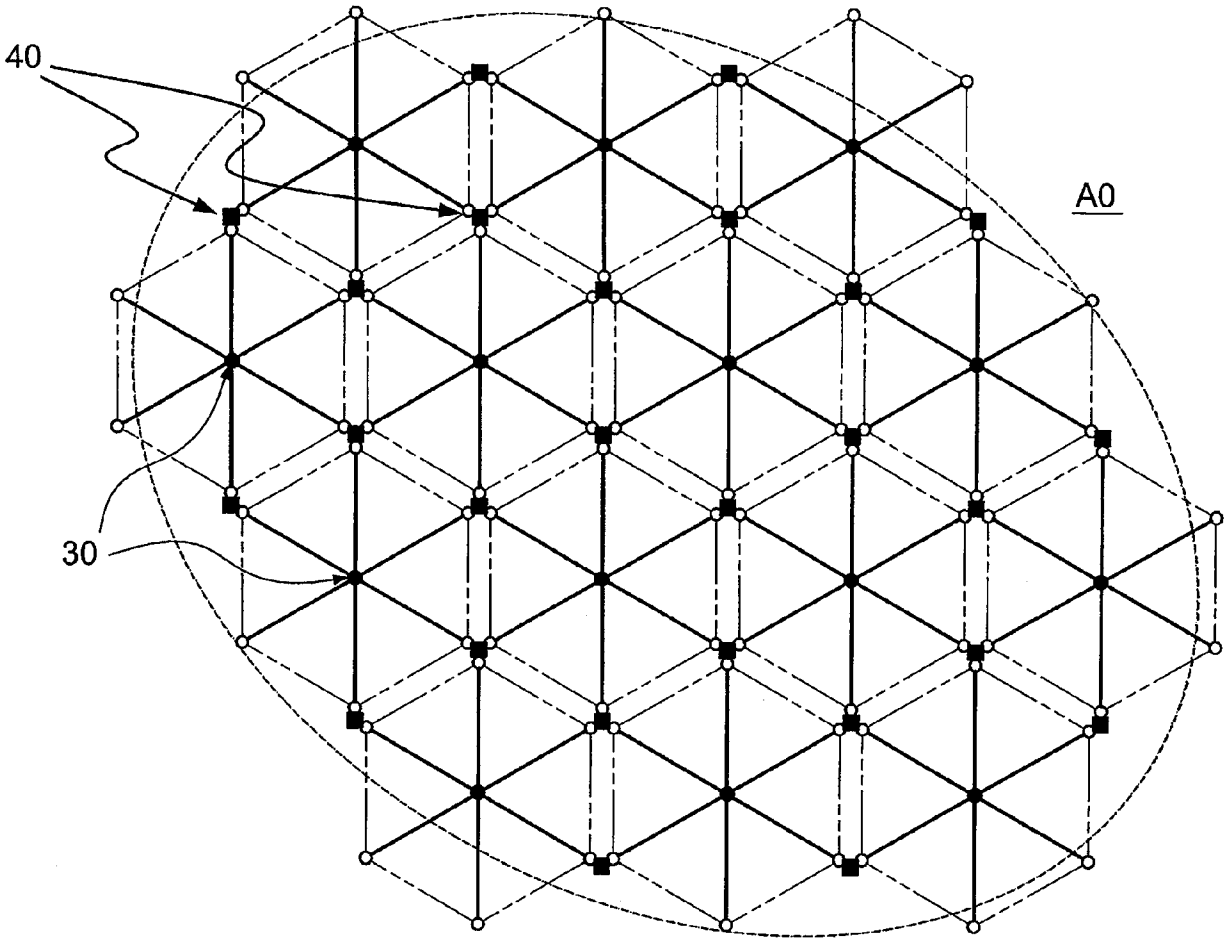
FIG. 3 RELATED ART
FIG. 3 is a view illustrating the back surface of the deployable antenna illustrated in FIG. 1.
Figure 4:
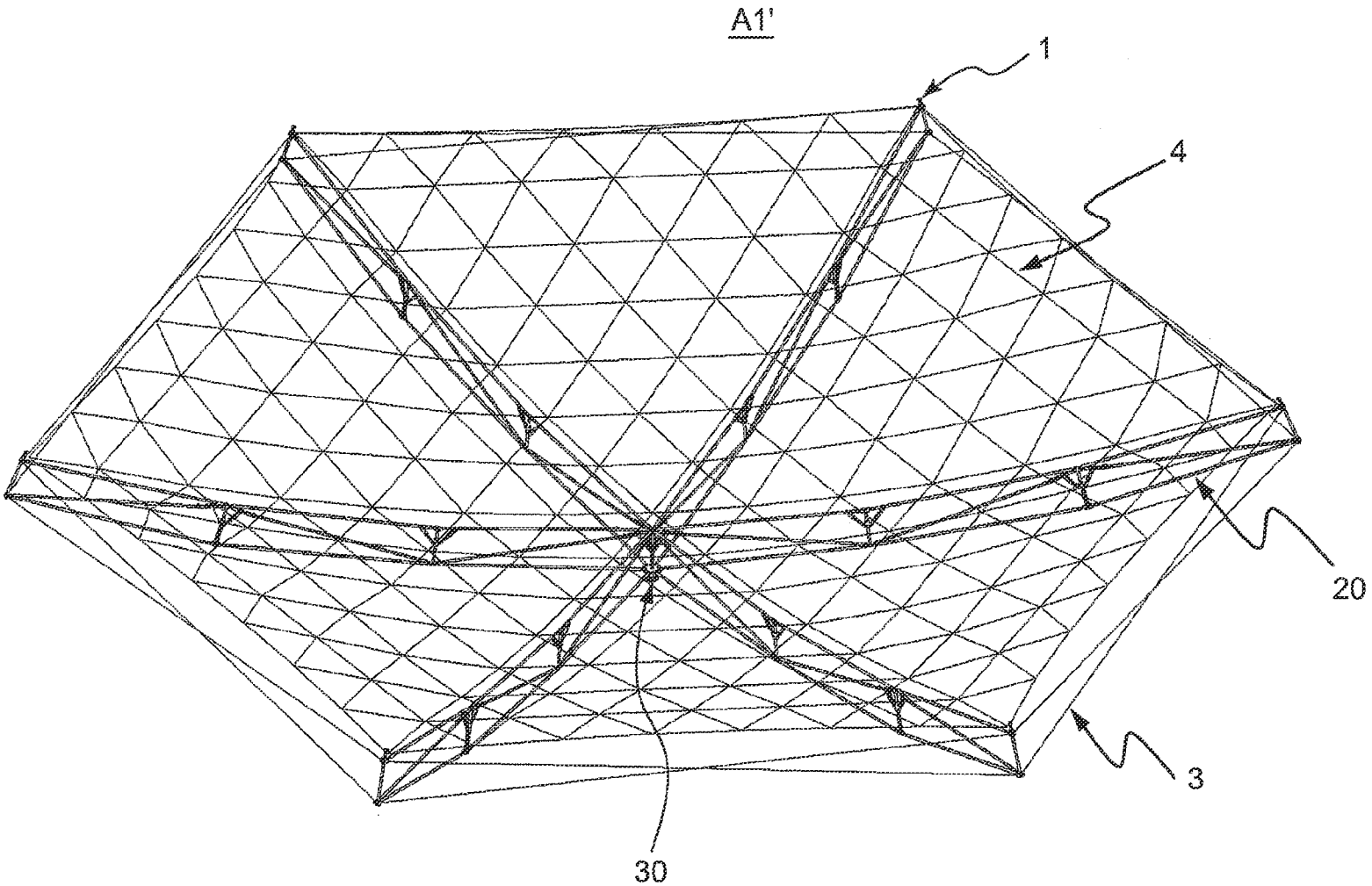
FIG. 4 is a perspective view of a deployable antenna according to a first embodiment of this invention.

FIG. 4 is an illustration of a deployable antenna A1' according to a first embodiment of this invention. The deployable antenna A1' alone may serve as a large deployable antenna corresponding to the large deployable antenna A0 illustrated in FIGS. 1 to 3.

The deployable antenna A1' is stowed in a folded state inside a fairing of a launch vehicle, and is deployed in orbit to form an antenna reflector mirror surface (flexible reflector mirror surface 4), which is formed of a flexible film surface, into a predetermined parabolic shape.

The deployable antenna A1' includes the flexible reflector mirror surface 4, an antenna deploying mechanism 1 that supports an outer edge portion of the flexible reflector mirror surface 4, and bands 3. The flexible reflector mirror surface 4 serves as a front surface of the deployable antenna A1'.

Figure 5:
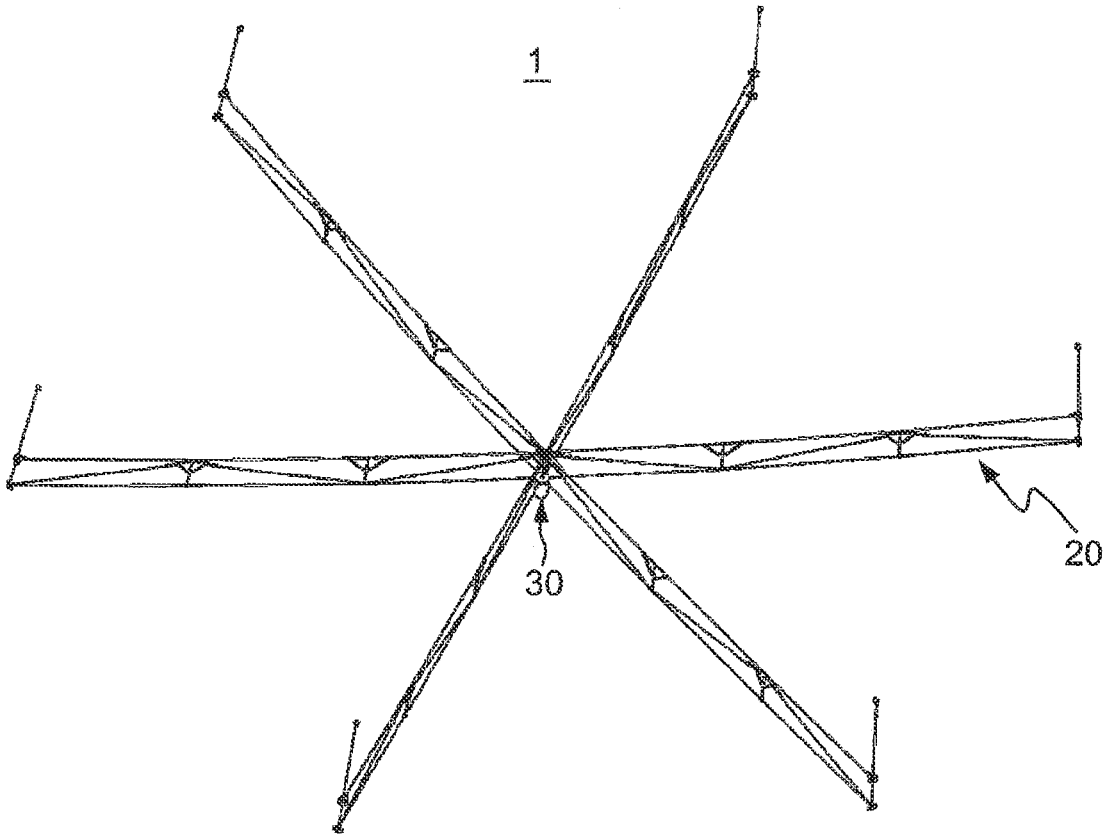
FIG. 5 is a perspective view of an antenna deploying mechanism of the deployable antenna illustrated in FIG. 4.

FIG. 5 is an illustration of the antenna deploying mechanism 1 of the deployable antenna A1' illustrated in FIG. 4.

The antenna deploying mechanism 1 includes six deployment link mechanisms 20 arranged radially from a central shaft of the antenna deploying mechanism 1 so as to support the outer edge portion of the flexible reflector mirror surface 4 at six points, and one deployment driving mechanism 30 arranged at a lower portion of the center of arrangement of the six deployment link mechanisms 20. The deployment driving mechanism 30 is an actuator mechanism part for unfolding the six deployment link mechanisms 20.

The bands 3 illustrated in FIG. 4 are provided so as to adjust a phase angle of each deployment link mechanism 20.

Figure 6:
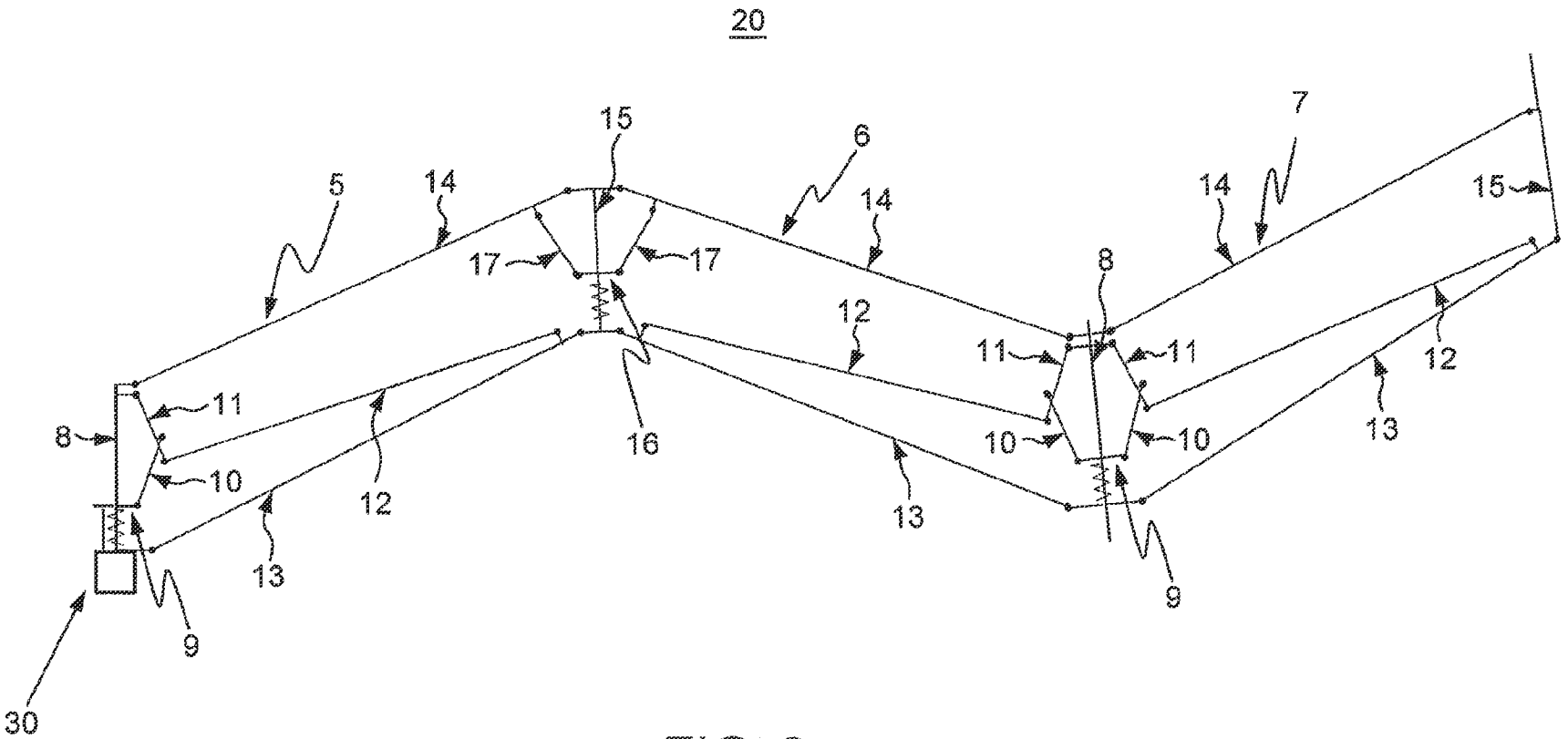
FIG. 6 is a view illustrating a deployment link mechanism of the antenna deploying mechanism illustrated in FIG. 5.

FIG. 6 is an illustration of a single deployment link mechanism 20 that is a component of the six deployment link mechanisms 20 of the antenna deploying mechanism 1 illustrated in FIG. 5.

The single deployment link mechanism 20 includes three four-side links 5, 6, and 7 arranged in an order from the position of the central shaft, around which the six deployment link mechanisms 20 are arranged, toward an outer side of the deployment link mechanism 20. Thus, the deployment link mechanism 20 is structured to be foldable in three stages. In FIG. 6, black spots represent hinge mechanisms.

Figure 1:
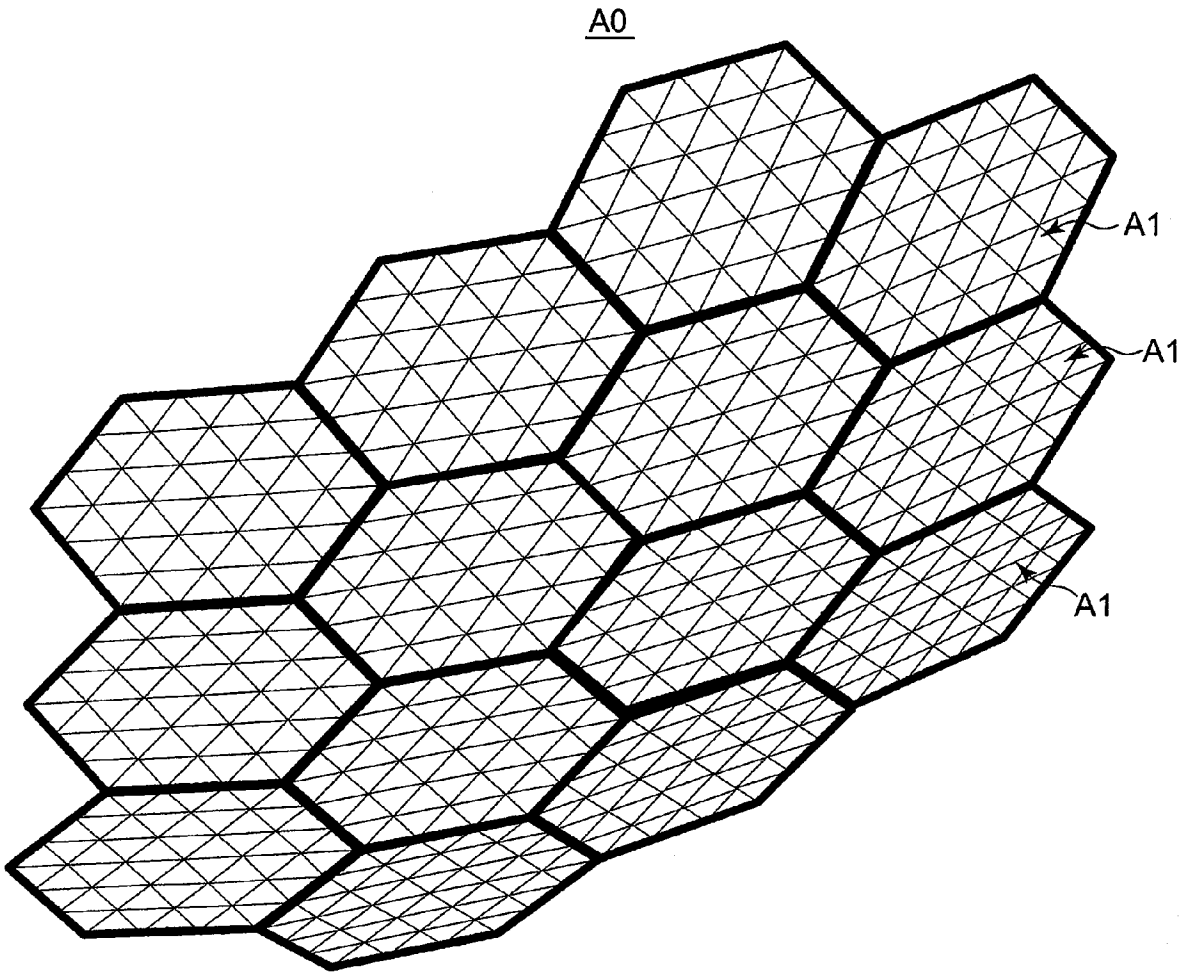
FIG. 1 RELATED ART
FIG. 1 is a view of a deployable antenna according to the related art as obliquely viewed to its front surface.
Figure 2:
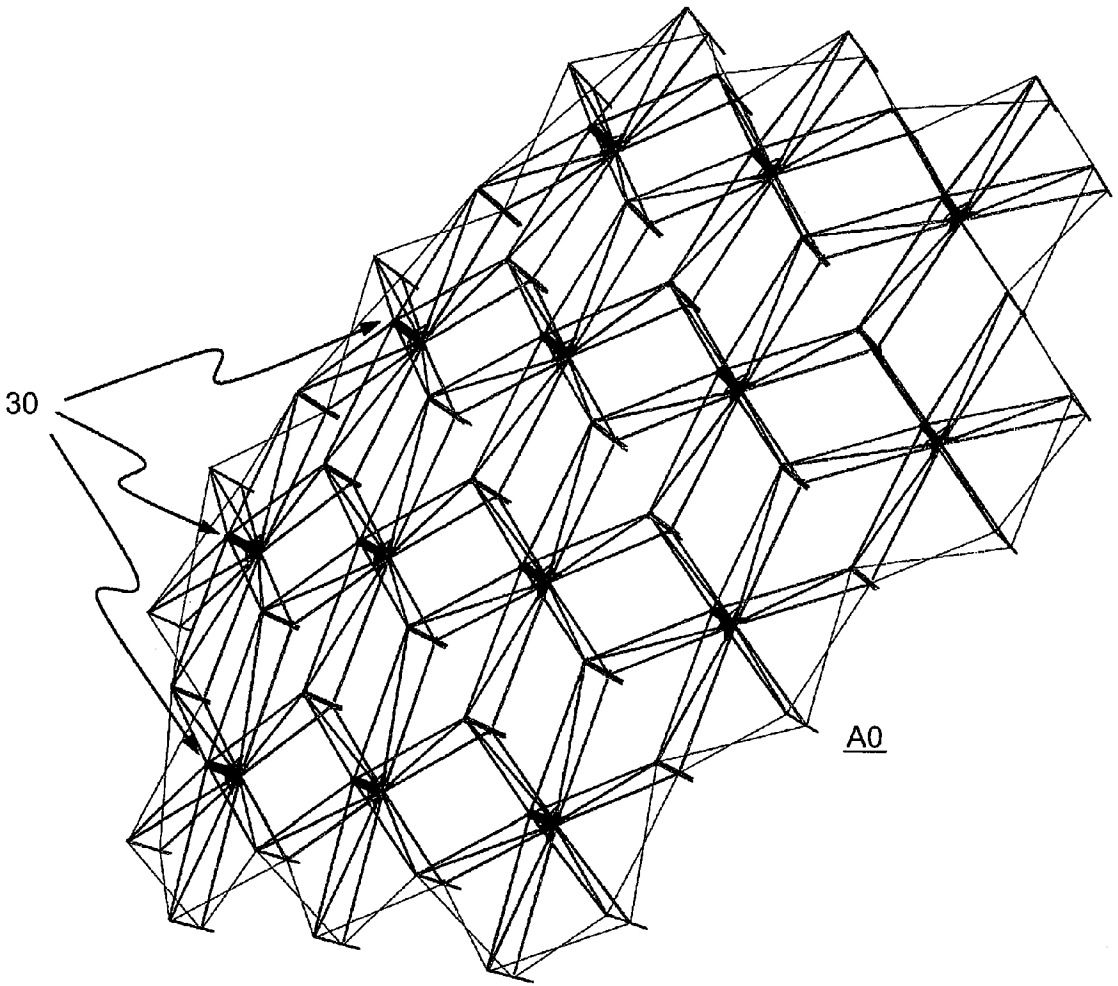
FIG. 2 RELATED ART
FIG. 2 is a view of the deployable antenna illustrated in FIG. 1 as obliquely viewed to its back surface.

Each deployable antenna module A1 of the deployable antenna A0 illustrated as the related art in FIGS. 1 to 3 has an antenna deploying mechanism similar to the antenna deploying mechanism 1 illustrated in FIG. 5. Specifically, the antenna deploying mechanism of the deployable antenna module A1 (FIGS. 1 to 3) also includes six radially arranged deployment link mechanisms 20 and one deployment driving mechanism 30. However, the deployment link mechanisms 20 of the deployable antenna module A1 (FIGS. 1 to 3) are each constructed of the four-side link 7 alone (single stage).

In contrast, according to the first embodiment, as illustrated in FIG. 6, the deployment link mechanism 20 is constructed of the four-side links 5, 6, and 7 (three stages: foldable in three stages).

In FIG. 6, a link member (central vertical link member) 8 of the four-side link 5, which serves as the central shaft, includes a slider 9. A link member (common vertical link member) 15 between the four-side links 5 and 6 includes a slider 16. Another link member (another common vertical link member) 8 between the four-side links 6 and 7 includes a slider 9.

In the single deployment link mechanism 20 illustrated in FIG. 6, the four-side link 6 is jointed to the four-side link 5 serving as a support structure for the deployable antenna A1', the four-side link 6 having a shape line-symmetric to that of the four-side link 5. Further, the four-side link 7 is jointed to the four-side link 6, the four-side link 7 having a shape line-symmetric to that of the four-side link 6. As described above, the three-fold structure is employed to increase an aperture diameter size of the single deployable antenna A1'. Specifically, the single deployable antenna A1' is structured to have an aperture diameter size that is substantially three times as large as the module aperture diameter size of the single deployable antenna module A1 (FIGS. 1 to 3). The deployable antenna A1' alone may serve as a large deployable antenna corresponding to the large deployable antenna A0 illustrated in FIGS. 1 to 3.

In a case where the large deployable antenna A0 illustrated in FIGS. 1 to 3 is constructed using the single deployable antenna A1' illustrated in FIG. 4, only one deployment driving mechanism 30 is necessary for the large deployable antenna A0, with the result that a lightweight, large deployable antenna is attained.

Figure 7:
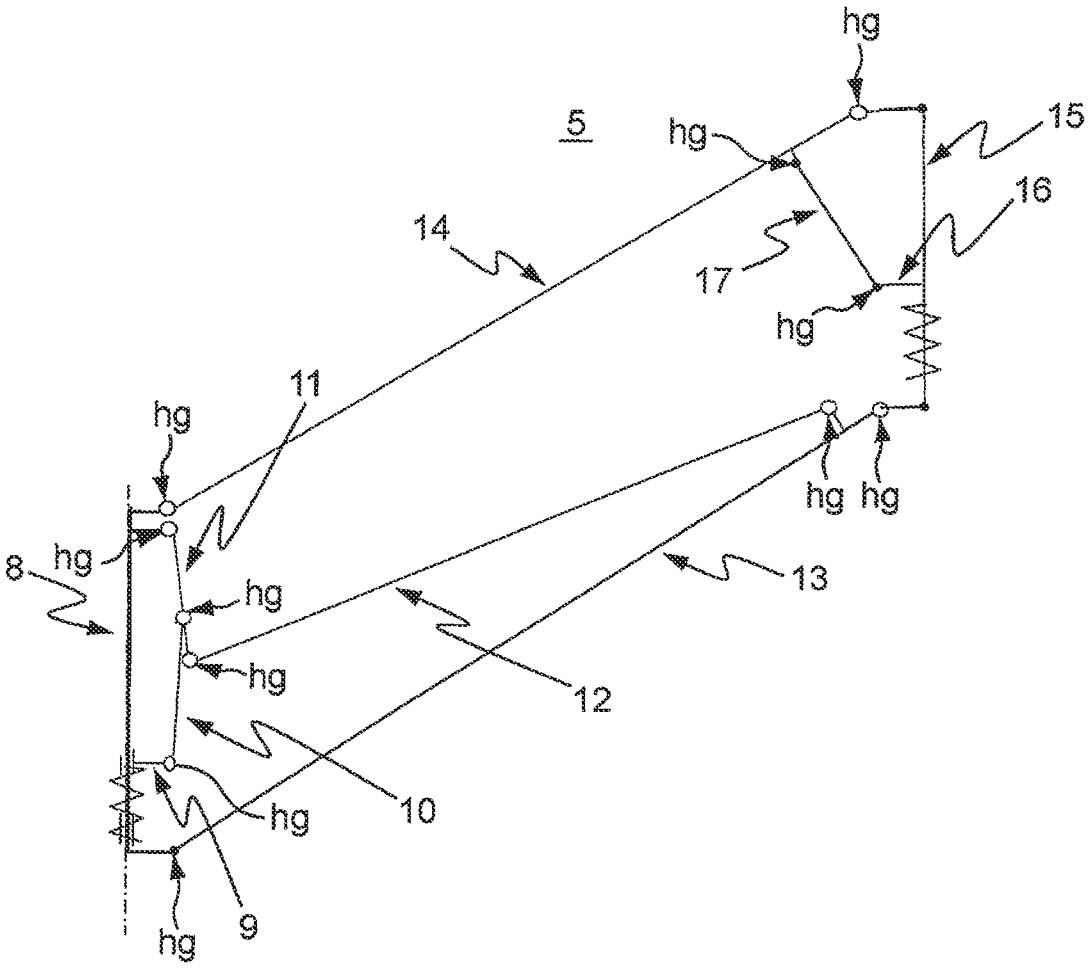
FIG. 7 is a view illustrating a four-side link situated at a left end of the deployment link mechanism illustrated in FIG. 6.

FIG. 7 is an illustration of the four-side link 5 situated at the left end of the deployment link mechanism 20 illustrated in FIG. 6.

The four-side link 5 is constructed of the link member 8 and link members 13, 14, and 15. To the four-side link 5, the slider 9, link members 10, 11, and 12, the slider 16, and a link member 17 are jointed through hinge mechanisms hg.

In FIGS. 6 and 7, the deployment driving mechanism 30 causes the slider 9 to slide upwardly along the central vertical link member 8 serving as the central shaft. Accordingly, the link member 10 brings the link members 11 and 12 into an extended state, to thereby unfold the four-side link 5. The unfolded four-side link 5 causes the slider 16 to slide upwardly along the common vertical link member 15, and accordingly the four-side link 6 is unfolded by the link member 17. In this manner, the unfolded shape of the four-side link 6 is synchronized with the unfolded shape of the four-side link 5. As for the structure between the four-side link 6 and the four-side link 7, the unfolded four-side link 6 causes the slider 9 to slide upwardly along the another common vertical link member 8. Accordingly, the link member 10 brings the link members 11 and 12 into an extended state, to thereby unfold the four-side link 7. In this manner, the unfolded shape of the four-side link 7 is synchronized with the unfolded shape of the four-side link 6.

Figure 8:
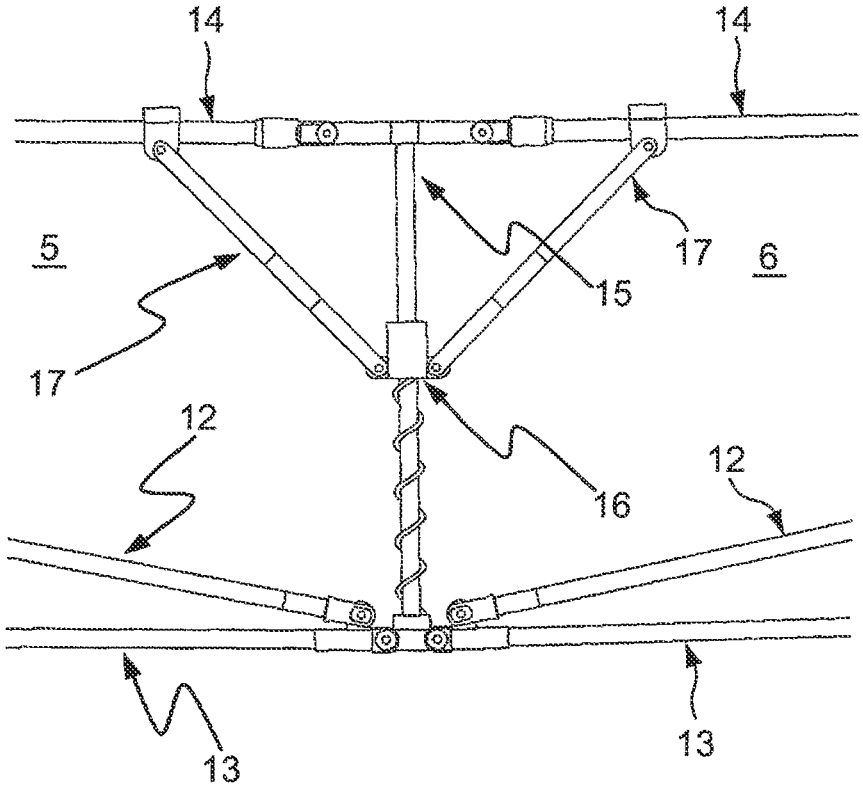
FIG. 8 is a view illustrating a right end portion of the four-side link situated at the left end of the deployment link mechanism illustrated in FIG. 6, and a left end portion of a four-side link situated at a center of the deployment link mechanism.

FIG. 8 is an illustration of a right end portion of the four-side link 5 situated at the left end of FIG. 6 and a left end portion of the four-side link 6 situated at the center of FIG. 6. The slider 16 moves vertically along the common vertical link member 15. One end of the link member 17 is rotatably fixed to the link member 14, and the other end of the link member 17 is rotatably fixed to the slider 16.

Figure 9:
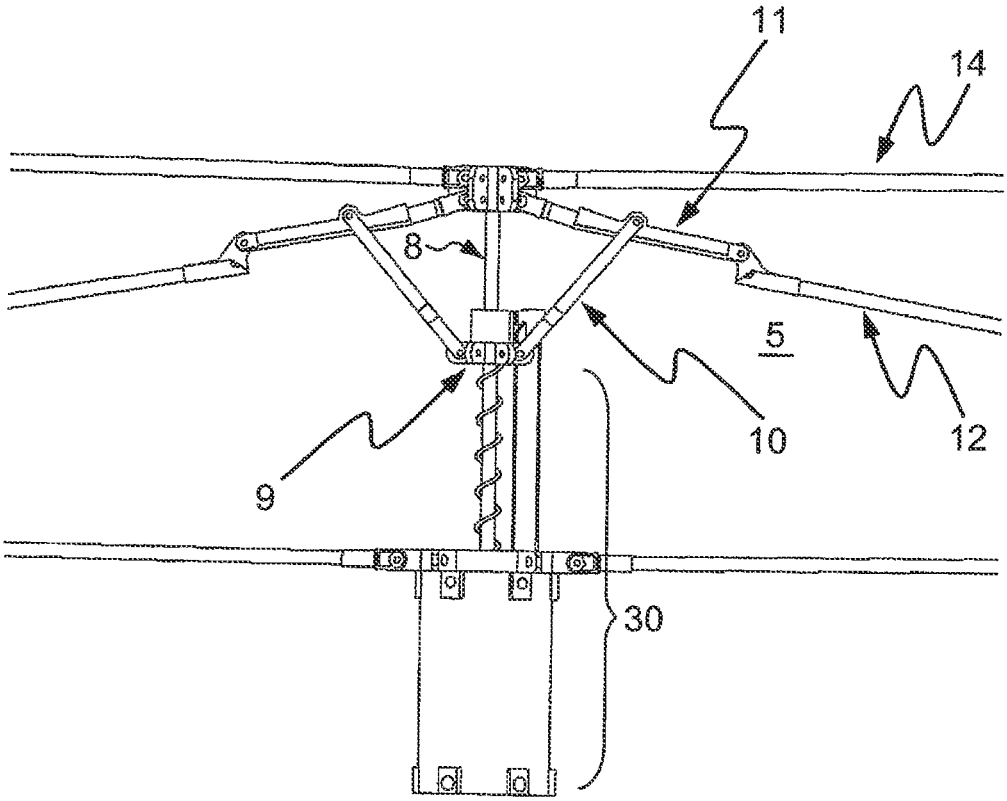
FIG. 9 is a view illustrating a left end portion of the four-side link situated at the left end of the deployment link mechanism illustrated in FIG. 6.

FIG. 9 is an illustration of a left end portion of the four-side link 5 situated at the left end of FIGS. 6 and 7.

Figure 10:
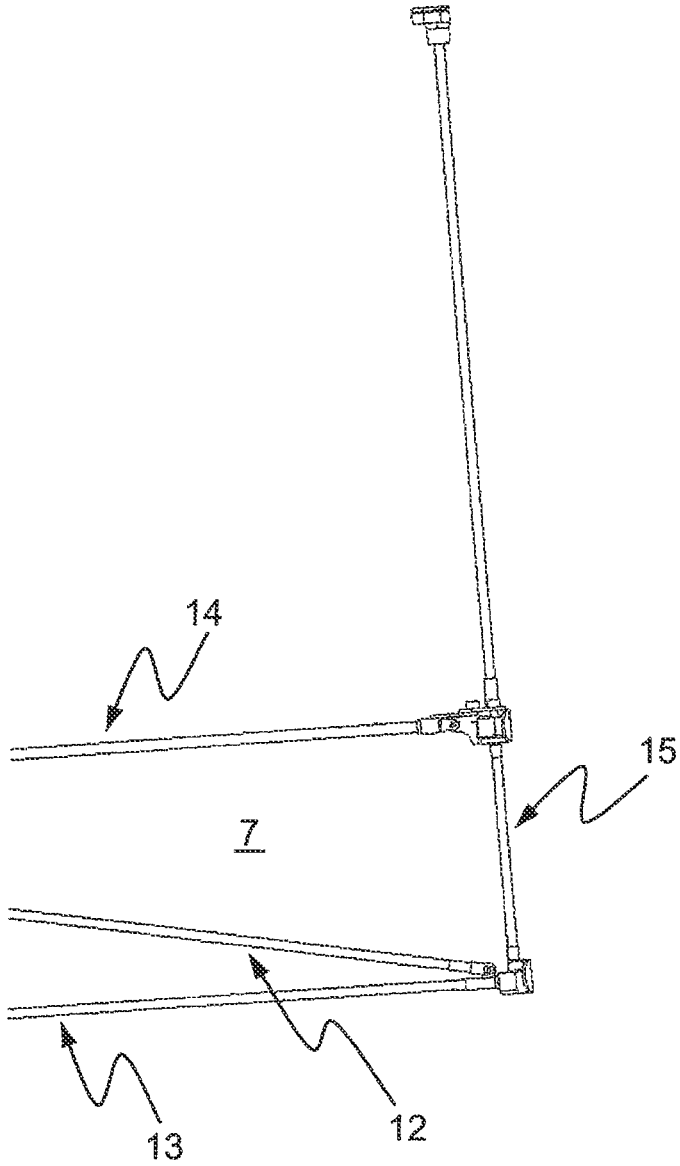
FIG. 10 is a view illustrating a right end portion of a four-side link situated at a right end of the deployment link mechanism illustrated in FIG. 6.

FIG. 10 is an illustration of a right end portion of the four-side link 7 situated at the right end of FIG. 6.

Figure 11:
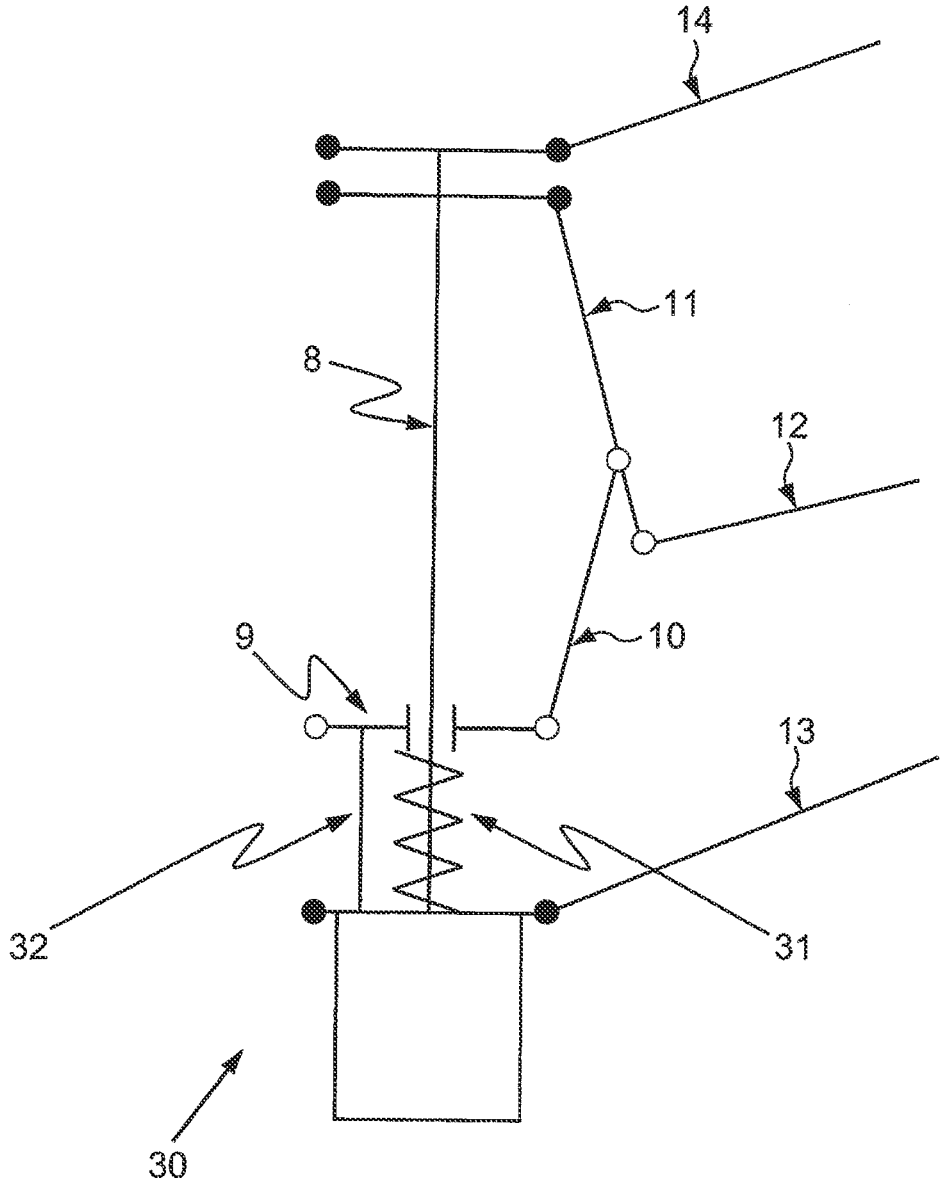
FIG. 11 is a view illustrating a deployment driving mechanism of the deployment link mechanism illustrated in FIG. 6.

FIG. 11 is an illustration of the deployment driving mechanism 30 of FIG. 6. The deployment driving mechanism 30 includes an actuator 31 (for example, a spring) for pushing the slider 9 up in the unfolding direction (that is, upwardly along the central vertical link member 8), and a damping device 32 (for example, a wire to be driven by a motor) for controlling the unfolding motion of the slider 9. Further, the four-side link may be folded when the damping device 32 is moved in a reverse direction.

Now, an operation of the above-mentioned first embodiment is described.

In FIG. 7, the deployment driving mechanism 30 causes the slider 9 to slide upwardly along the central vertical link member 8. Accordingly, the link member 10 brings the link members 11 and 12 into an extended state, to thereby unfold the four-side link 5 constructed of the link members 8, 13, 14, and 15.

The link members 11 and 12 in the extended state serve as a structure for stably maintaining the shape of the four-side link 5 in the unfolded state.

In FIG. 7, the unfolding force to be imparted by the slider 16 promotes the unfolding force to be imparted by the slider 9, and accordingly promotes the unfolding force of the entire deployment link mechanism 20.

In FIG. 6, the four-side link 6 is line-symmetric to the four-side link 5, and hence unfolded line-symmetrically to the four-side link 5. Similarly, the four-side link 7 is unfolded line-symmetrically to the four-side link 6. Thus, the deployment link mechanism 20 constructed of the four-side links 5, 6, and 7 is unfolded and folded in accordance with the sliding motion of the sliders 9 and 16.

In the first embodiment, the deployment link mechanisms 20 foldable in three stages are used to provide a mechanism capable of folding and unfolding the deployable antenna A1' having a large aperture diameter.

The first embodiment enables the single deployable antenna A1' to serve as a large deployable antenna, to thereby reduce the weight of the large deployable antenna.

Note that, in order to obtain a deployable antenna having such a large aperture diameter size that cannot be attained by the single deployable antenna A1' according to the first embodiment, similarly to the deployable antenna A0 of FIGS. 1 to 3, the outermost peripheral portions of a plurality of deployable antennas A1' (outermost peripheral portions of four-side links 7) only need to be jointed to one another by a plurality of joint members 40 (FIG. 3) to construct a jointed-type deployable antenna having a large aperture diameter size.

Figure 12:
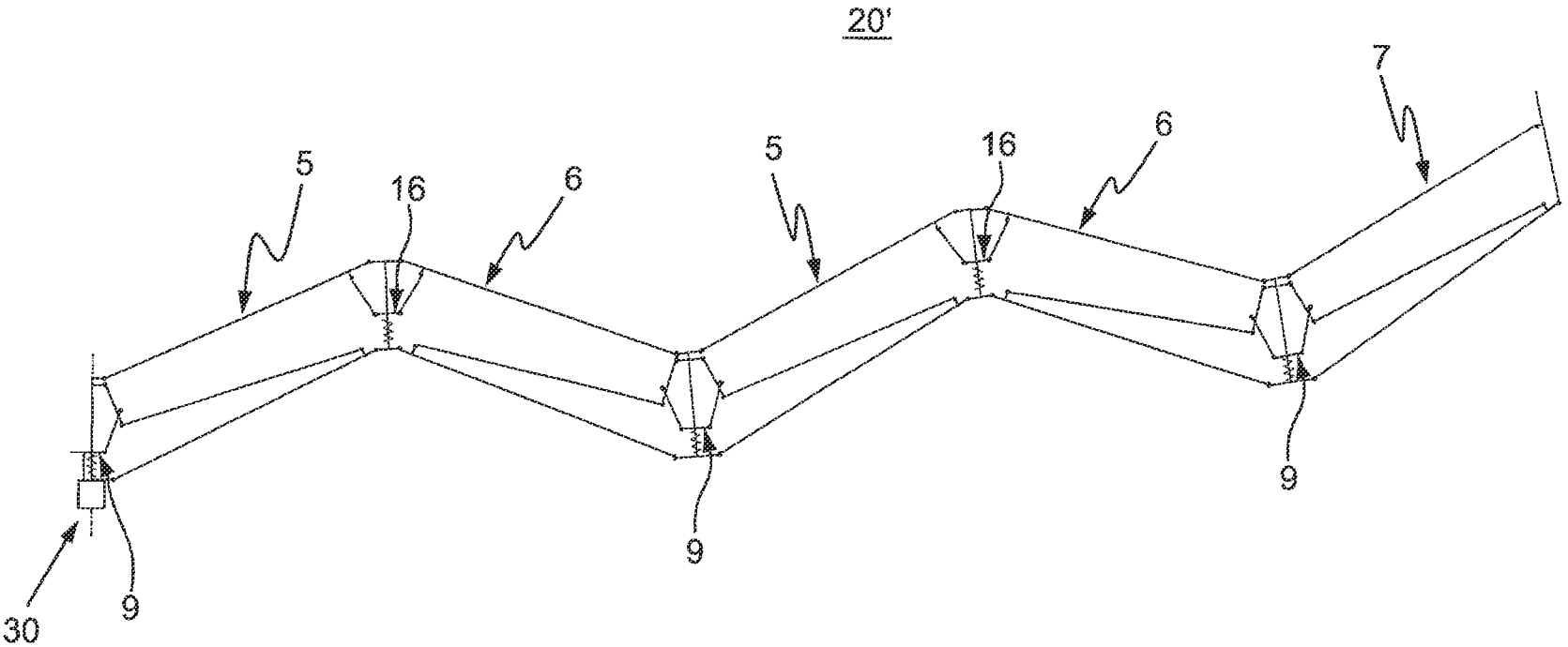
FIG. 12 is a view illustrating a deployment link mechanism to be used in a deployable antenna according to a second embodiment of this invention.

FIG. 12 is an illustration of a deployment link mechanism 20' to be used in a deployable antenna according to a second embodiment of this invention. The deployment link mechanism 20' is constructed of five four-side links 5, 6, 5, 6, and 7, to thereby provide a deployment link mechanism foldable in five stages. The deployment link mechanism 20' is obtained by adding two four-side links 5 and 6 between the four-side links 6 and 7 of the deployment link mechanism 20 of FIG. 6. The two added four-side links 5 and 6 have substantially the same structures as the four-side links 5 and 6 of the deployment link mechanism 20 of FIG. 6.

As described above, the five-fold structure is employed to increase the aperture diameter size of the deployable antenna. Specifically, the deployable antenna is structured to have an aperture diameter size that is substantially five times as large as the module aperture diameter size of the deployable antenna module A1 (FIGS. 1 to 3). The deployable antenna alone may also serve as a large deployable antenna corresponding to the large deployable antenna A0 illustrated in FIGS. 1 to 3.

Note that, in order to obtain a deployable antenna having such a large aperture diameter size that cannot be attained by the single deployable antenna according to the second embodiment, similarly to the deployable antenna A0 of FIGS. 1 to 3, the outermost peripheral portions of a plurality of deployable antennas (outermost peripheral portions of four-side links 7) only need to be jointed to one another by a plurality of joint members 40 (FIG. 3) to construct a jointed-type deployable antenna having a large aperture diameter size.

Now, referring to FIGS. 4 to 7 and 12, various structures of the deployable antenna according to the first and second embodiments are summarized in the following items (1) to (7):

(1) A deployable antenna, including:

six deployment link mechanisms 20 arranged radially from a central shaft of the deployable antenna so as to support an outer edge portion of a flexible reflector mirror surface 4 of the deployable antenna; and one deployment driving mechanism 30 arranged at a lower portion of a center of arrangement of the six deployment link mechanisms 20, for unfolding the six deployment link mechanisms 20, in which each of the six deployment link mechanisms 20 includes a first four-side link 5, a second four-side link 6, and a third four-side link 7 arranged in an order from a position of the central shaft, around which the six deployment link mechanisms 20 are arranged, toward an outer side of the each of the six deployment link mechanisms 20 so that the each of the six deployment link mechanisms 20 is structured to be foldable in three stages, in which a central vertical link member 8 of the first four-side link 5, which serves as the central shaft, includes a first slider 9, in which a common vertical link member 15 between the first four-side link 5 and the second four-side link 6 includes a second slider 16, in which another common vertical link member 8 between the second four-side link 6 and the third four-side link 7 includes a third slider 9, in which the one deployment driving mechanism 30 causes the first slider 9 to slide upwardly along the central vertical link member 8, to thereby unfold the first four-side link 5, in which the unfolded first four-side link 5 causes the second slider 16 to slide upwardly along the common vertical link member 15, to thereby unfold the second four-side link 6, and in which the unfolded second four-side link 6 causes the third slider 9 to slide upwardly along the another common vertical link member 8, to thereby unfold the third four-side link 7.

(2) A deployable antenna according to the above-mentioned item (1), in which the first four-side link 5 includes link mechanisms 10, 11, and 12 to be brought into an extended state when the one deployment driving mechanism 30 causes the first slider 9 to slide upwardly along the central vertical link member 8, to thereby unfold the first four-side link 5.

(3) A deployable antenna according to the above-mentioned item (1) or (2), in which the first four-side link 5 further includes a first promoting link member 17 for promoting unfolding of the first four-side link 5 when the unfolded first four-side link 5 causes the second slider 16 to slide upwardly along the common vertical link member 15, and in which the second four-side link 6 includes a second promoting link member 17 for promoting unfolding of the second four-side link 6 when the unfolded first four-side link 5 causes the second slider 16 to slide upwardly along the common vertical link member 15.

(4) A deployable antenna according to any one of the above-mentioned items (1) to (3), in which the third four-side link 7 includes link mechanisms 10, 11, and 12 to be brought into an extended state when the unfolded second four-side link 6 causes the third slider 9 to slide upwardly along the another common vertical link member 8, to thereby unfold the third four-side link 7.

(5) A jointed-type deployable antenna, including:

a plurality of the deployable antennas A1' according to any one of the above-mentioned items (1) to (4); and a plurality of joint members 40 (FIG. 3) for jointing outermost peripheral portions of the plurality of the deployable antennas to one another.

(6) A deployable antenna according to the above-mentioned item (1), in which the each of the six deployment link mechanisms 20' further includes a fourth four-side link 5 and a fifth four-side link 6 arranged between the second four-side link 6 and the third four-side link 7 so that the each of the six deployment link mechanisms 20' is structured to be foldable in five stages, and in which the fourth four-side link 5 and the fifth four-side link 6 have substantially the same structures as the first four-side link 5 and the second four-side link 6.

(7) A jointed-type deployable antenna, including:

a plurality of the deployable antennas according to the above-mentioned item (6); and a plurality of joint members 40 (FIG. 3) for jointing outermost peripheral portions of the plurality of the deployable antennas to one another.

Figure 13:
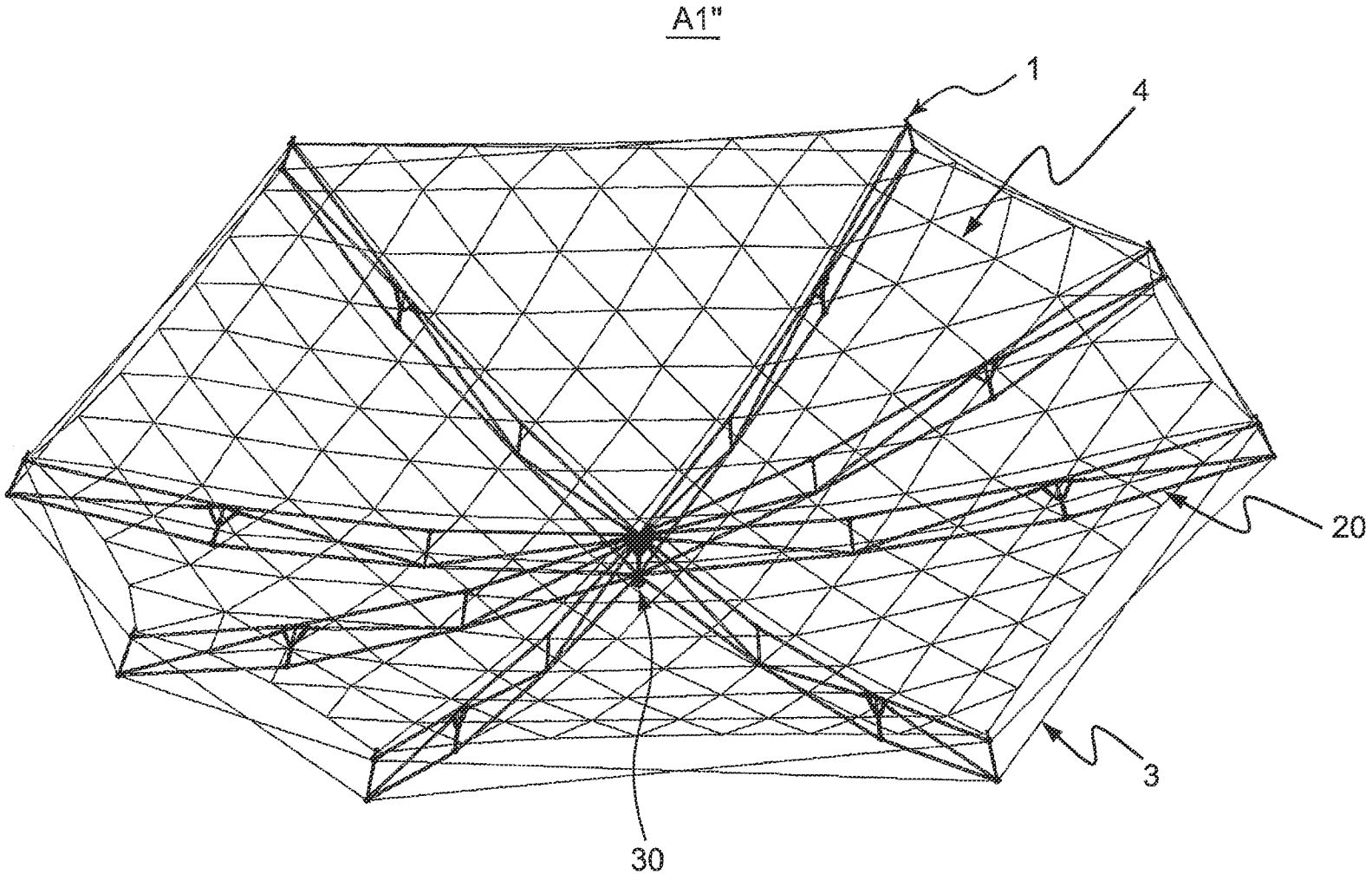
FIG. 13 is a perspective view of a deployable antenna according to a third embodiment of this invention.

FIG. 13 is an illustration of a deployable antenna A1" according to a third embodiment of this invention. The deployable antenna A1" is an octagonal deployable antenna obtained by radially providing the deployment link mechanisms 20 at eight points so as to support the outer peripheral edge portion of the flexible reflector mirror surface 4 at eight points. The octagonal deployable antenna A1" has such an elliptical aperture shape that an axial projection shape of the parabola of the flexible reflector mirror surface 4 is formed into a circular aperture. Each of the deployment link mechanisms 20 provided at eight points has a similar structure as that of FIGS. 6 and 7.

Note that, in the deployable antenna A1" illustrated in FIG. 13, the deployment link mechanism 20' illustrated in FIG. 12 may be used as each of the eight deployment link mechanisms 20. As described above, the deployment link mechanism 20' is constructed of five four-side links 5, 6, 5, 6, and 7, to thereby provide a deployment link mechanism foldable in five stages. The deployment link mechanism 20' is obtained by adding two four-side links 5 and 6 between the four-side links 6 and 7 of the deployment link mechanism 20 of FIG. 6. The two added four-side links 5 and 6 have substantially the same structures as the four-side links 5 and 6 of the deployment link mechanism 20 of FIG. 6.

Now, referring to FIGS. 13, 6, 7, and 12, various structures of the deployable antenna A1" according to the third embodiment are summarized in the following items (8) and (9):

(8) A deployable antenna A1", including:

eight deployment link mechanisms 20 arranged radially from a central shaft of the deployable antenna so as to support an outer edge portion of a flexible reflector mirror surface 4 of the deployable antenna; and one deployment driving mechanism 30 arranged at a lower portion of a center of arrangement of the eight deployment link mechanisms 20, for unfolding the eight deployment link mechanisms 20, in which each of the eight deployment link mechanisms 20 includes a first four-side link 5, a second four-side link 6, and a third four-side link 7 arranged in an order from a position of the central shaft, around which the eight deployment link mechanisms 20 are arranged, toward an outer side of the each of the eight deployment link mechanisms 20 so that the each of the eight deployment link mechanisms 20 is structured to be foldable in three stages, in which a central vertical link member 8 of the first four-side link 5, which serves as the central shaft, includes a first slider 9, in which a common vertical link member 15 between the first four-side link 5 and the second four-side link 6 includes a second slider 16, in which another common vertical link member 8 between the second four-side link 6 and the third four-side link 7 includes a third slider 9, in which the one deployment driving mechanism 30 causes the first slider 9 to slide upwardly along the central vertical link member 8, to thereby unfold the first four-side link 5, in which the unfolded first four-side link 5 causes the second slider 16 to slide upwardly along the common vertical link member 15, to thereby unfold the second four-side link 6, and in which the unfolded second four-side link 6 causes the third slider 9 to slide upwardly along the another common vertical link member 8, to thereby unfold the third four-side link 7.

(9) A deployable antenna according to the above-mentioned item (8), in which the each of the eight deployment link mechanisms 20 further includes a fourth four-side link 5 and a fifth four-side link 6 arranged between the second four-side link 6 and the third four-side link 7 so that the each of the eight deployment link mechanisms 20 is structured to be foldable in five stages, and in which the fourth four-side link 5 and the fifth four-side link 6 have substantially the same structures as the first four-side link 5 and the second four-side link 6.

This invention is applicable to a folding mechanism of a deployable antenna, of the parabolic antennas to be mounted onto an artificial satellite or the like.

This invention has been described above in detail with reference to the embodiments, but this invention is not limited to the embodiments described above. Various modifications understandable for a person having ordinary skill in the art may be made to the structures and details of this invention within the scope of this invention.

What is claimed is:

1. A deployable antenna, comprising:

a flexible reflector mirror surface having an outer edge portion;

six deployment link mechanisms arranged radially from a central shaft of the deployable antenna so as to support the outer edge portion of the flexible reflector mirror surface of the deployable antenna; and one deployment driving mechanism arranged at a lower portion of a center of arrangement of the six deployment link mechanisms, for unfolding the six deployment link mechanisms, wherein each of the six deployment link mechanisms comprises a first four-side link, a second four-side link, and a third four-side link arranged in an order from a position of the central shaft, around which the six deployment link mechanisms are arranged, toward an outer side of the each of the six deployment link mechanisms so that the each of the six deployment link mechanisms is structured to be foldable in three stages, each of the first four-side link, the second-four side link, and the third four-side link having four sides, wherein:

the first four-side link has four first side link members and first link members coupled within the four first side link members, one of the four first side link members acting as the central shaft and having a first slider while another one of the four first side link members has a second slider and is common to the second-four side link, the first link members being coupled to the first slider and the second slider and to either one of the four first side link members;

wherein:

the second four-side link has four second side link members and second link members coupled within the four second side link members of the second four-side link, one of the four second side link members of the second four-side link being the another one of the four first side link members and acting as a common vertical link member common to the first four-side link and having the second slider used in common to the first four-side link, while another one of the four second side link members of the second four-side link is used in common with the third four-side link; and wherein:

the third four-side link has four third side link members and third link members coupled within the four third side link members of the third four-side link, one of the four third side link members of the third four-side link being the another one of the four second side link members and acting as another common vertical link member common to the second four-side link and having a third slider coupled to the third link members of the third four-side link.

2. A deployable antenna according to claim 1, wherein the first four-side link comprises a link mechanism to be brought into an extended state when the one deployment driving mechanism causes the first slider to slide upwardly along the central shaft, to thereby unfold the first four-side link.

3. A deployable antenna according to claim 1, wherein the first four-side link further comprises a first promoting link member for promoting unfolding of the first four-side link when the unfolded first four-side link causes the second slider to slide upwardly along the common vertical link member, and wherein the second four-side link comprises a second promoting link member for promoting unfolding of the second four-side link when the unfolded first four-side link causes the second slider to slide upwardly along the common vertical link member.

4. A deployable antenna according to claim 1, wherein the third four-side link comprises a link mechanism to be brought into an extended state when the unfolded second four-side link causes the third slider to slide upwardly along the another common vertical link member, to thereby unfold the third four-side link.

5. A jointed-type deployable antenna, comprising:

a plurality of the deployable antennas according to claim 1; and a plurality of joint members for jointing outermost peripheral portions of the plurality of the deployable antennas to one another.

6. A deployable antenna according to claim 1, wherein the each of the six deployment link mechanisms further comprises a fourth four-side link and a fifth four-side link arranged between the second four-side link and the third four-side link so that the each of the six deployment link mechanisms is structured to be foldable in five stages, and wherein the fourth four-side link and the fifth four-side link have substantially the same structures as the first four-side link and the second four-side link.

7. A jointed-type deployable antenna, comprising:

a plurality of the deployable antennas according to claim 6; and a plurality of joint members for jointing outermost peripheral portions of the plurality of the deployable antennas to one another.

8. A deployable antenna, comprising:

a flexible reflector mirror surface having an outer edge portion;

eight deployment link mechanisms arranged radially from a central shaft of the deployable antenna so as to support the outer edge portion of the flexible reflector minor surface of the deployable antenna; and one deployment driving mechanism arranged at a lower portion of a center of arrangement of the eight deployment link mechanisms, for unfolding the eight deployment link mechanisms, wherein each of the eight deployment link mechanisms comprises a first four-side link, a second four-side link, and a third four-side link arranged in an order from a position of the central shaft, around which the eight deployment link mechanisms are arranged, toward an outer side of the each of the eight deployment link mechanisms so that the each of the eight deployment link mechanisms is structured to be foldable in three stages, each of the first four-side link, the second four-side link, and the third four-side link having four sides, wherein:

the first four-side link has four first side link members and first link members coupled within the four first side link members, one of the four first side link members acting as the central shaft and having a first slider while another one of the four first side link members has a second slider and is common to the second-four side link, the first link members being coupled to the first slider and the second slider and to either one of the four first side link members;

wherein:

the second four-side link has four second side link members and second link members coupled within the four second side link members of the second four-side link, one of the four second side link members of the second four-side link being the another one of the four first side link members and acting as a common vertical link member common to the first four-side link and having the second slider used in common to the first four-side link, while another one of the four second side link members of the second four-side link is used in common with the third four-side link; and wherein:

the third four-side link has four third side link members and third link members coupled within the four third side link members of the third four-side link, one of the four third side link members of the third four-side link being the another one of the four second side link members and acting as another common vertical link member common to the second four-side link and having a third slider coupled to the third link members of the third four-side link.

9. A deployable antenna according to claim 8, wherein the each of the eight deployment link mechanisms further comprises a fourth four-side link and a fifth four-side link arranged between the second four-side link and the third four-side link so that the each of the eight deployment link mechanisms is structured to be foldable in five stages, and wherein the fourth four-side link and the fifth four-side link have substantially the same structures as the first four-side link and the second four-side link.

* * * * *

UNITED STATES PATENT AND TRADEMARK OFFICE

CERTIFICATE OF CORRECTION

PATENT NO. : 8,922,456 B2
APPLICATION NO. : 13/361234
DATED : December 30, 2014
INVENTOR(S) : Minoru Tabata It is certified that error appears in the above-identified patent and that said Letters Patent is hereby corrected as shown below:

In the Claims

Column 11, Line 39: In Claim 8, delete “minor” and insert -- mirror --

Signed and Sealed this
Sixteenth Day of June, 2015

Michelle K. Lee

Michelle K. Lee
*Director of the United States Patent and Trademark Office*